US011702324B2

(12) United States Patent
Urban

(10) Patent No.: US 11,702,324 B2
(45) Date of Patent: Jul. 18, 2023

(54) VEHICLE CRANE COMPRISING A MOVABLE ADAPTER BETWEEN THE MAIN BOOM AND THE MAIN BOOM EXTENSION

(71) Applicant: Tadano Demag GmbH, Zweibrucken (DE)

(72) Inventor: Christian Moritz Urban, Zweibrücken (DE)

(73) Assignee: TADANO DEMAG GMBH, Zweibrücken (DE)

( * ) Notice: Subject to any disclaimer, the term of this patent is extended or adjusted under 35 U.S.C. 154(b) by 265 days.

(21) Appl. No.: 17/255,855

(22) PCT Filed: Jun. 19, 2019

(86) PCT No.: PCT/EP2019/066130
§ 371 (c)(1),
(2) Date: Dec. 23, 2020

(87) PCT Pub. No.: WO2020/002066
PCT Pub. Date: Jan. 2, 2020

(65) Prior Publication Data

US 2021/0261388 A1 Aug. 26, 2021

(30) Foreign Application Priority Data

Jun. 27, 2018 (DE) ..... 10 2018 115 519.0

(51) Int. Cl.
*B66C 23/42* (2006.01)
*B66C 23/68* (2006.01)
*B66C 23/70* (2006.01)

(52) U.S. Cl.
CPC ..... *B66C 23/42* (2013.01); *B66C 23/68* (2013.01); *B66C 23/702* (2013.01)

(58) Field of Classification Search
CPC ..... B66C 23/06; B66C 23/42; B66C 23/62; B66C 23/68; B66C 23/70; B66C 23/82; B66C 23/702
(Continued)

(56) References Cited

U.S. PATENT DOCUMENTS 6,276,541 B1 * 8/2001 Gevaudant ..... B66C 23/34 212/300
7,878,346 B1 * 2/2011 Watts et al. ..... B66C 23/04 212/168
2005/0011850 A1 1/2005 Hinrichs et al.

FOREIGN PATENT DOCUMENTS

CN 101898728 A 12/2010
DE 4314779 A1 * 11/1994 ..... B66C 23/26
(Continued)

OTHER PUBLICATIONS

Preliminary Report on Patentability of the International Searching Authority in English from corresponding Patent Cooperation Treaty (PCT) Application No. PCT/EP2019/066130, completed Dec. 29, 2020.
(Continued)

*Primary Examiner* — Michael R Mansen
*Assistant Examiner* — Henrix Soto
(74) *Attorney, Agent, or Firm* — Gardner, Linn, Burkhart & Ondersma

(57) ABSTRACT

A vehicle crane, such as a mobile crane or a crawler crane, includes a main boom, a main boom extension, and an adapter that is located between the main boom and the main boom extension and which has a first connection plane and a second connection plane. The adapter is configured to be movable such that the first connection plane can be moved relative to the second connection plane, where the adapter is designed in the manner of a double lever in order to provide
(Continued)

a vehicle crane that has improved load-bearing capacity and simplified set-up.

19 Claims, 5 Drawing Sheets

(58) Field of Classification Search
USPC ..... 212/299
See application file for complete search history.

(56) References Cited

FOREIGN PATENT DOCUMENTS

| | | | | |
|---|---|---|---|---|
| DE | 20107984 | U1 | 12/2001 | |
| DE | 102015001619 | A1 | 8/2016 | |
| DE | 102015119381 | B3 * | 4/2017 | ..... B66C 23/42 |
| DE | 102016009038 | A1 | 1/2018 | |
| EP | 0536060 | A1 | 4/1993 | |
| EP | 0536060 | A1 * | 7/1993 | ..... B66C 23/68 |
| EP | 0728695 | A1 | 8/1996 | |
| EP | 0733584 | A1 * | 9/1996 | ..... B66C 23/34 |
| EP | 0888997 | A1 * | 1/1999 | ..... B66C 23/34 |
| GB | 1470488 | A | 4/1977 | |
| WO | WO-2016131753 | A1 * | 8/2016 | ..... B66C 23/62 |

OTHER PUBLICATIONS

International Search Report of the International Searching Authority from corresponding Patent Cooperation Treaty (PCT) Application No. PCT/EP2019/066130, indicated completed on Oct. 14, 2019.

International Written Opinion of the International Searching Authority from corresponding Patent Cooperation Treaty (PCT) Application No. PCT/EP2019/066130, indicated completed on Oct. 14, 2019.

* cited by examiner

VEHICLE CRANE COMPRISING A MOVABLE ADAPTER BETWEEN THE MAIN BOOM AND THE MAIN BOOM EXTENSION

CROSS REFERENCE TO RELATED APPLICATION

The present application claims the priority benefits of International Patent Application No. PCT/EP2019/066130, filed Jun. 19, 2019, and claims benefit of DE 10 2018 115 519.0, filed on Jun. 27, 2018.

FIELD OF THE INVENTION

The invention relates to a vehicle crane, in particular a mobile crane or crawler crane, comprising a main jib, a main jib extension and an adapter which is arranged between the main jib and the main jib extension and has a first connection plane and a second connection plane, where the adapter is movable such that the first connection plane can be moved relative to the second connection plane.

BACKGROUND OF THE INVENTION

A vehicle crane comprising a telescopic main jib and a main jib extension is known from the German utility model DE 201 07 984 U1. The main jib extension is fastened to a head of the main jib via an adapter. The bending-resistant adapter is arranged at its lower end and thus in a first connection plane in a fixed manner on the head of the main jib and at its upper end the main jib extension and thus a second connection plane are mounted so as to be luffable about a horizontal luffing axis. Arranged in the region of the lower end of the main jib extension and in the region of the adapter are a total of four luffing supports which protrude in each case in pairs, as seen in the longitudinal direction of the main jib extension, in a v-shaped manner rearwards, and cables or guying rods are arranged at the ends thereof. In relation to such vehicle cranes comprising a luffable main jib extension, it is generally known to arrange the luffing axis either at the front on the edge of the adapter or centrally on the adapter.

German laid-open document DE 10 2016 009 038 A1 discloses a comparable vehicle crane comprising a telescopic main jib and a main jib extension. However, the adapter therein is not bending-resistant. The adapter is fastened only one side in a rigid manner to the jib head but on the other side a fastening frame which can be pivoted about a luffing axis is provided for fastening the main jib extension. For the purpose of a luffing movement of the main jib extension, this fastening frame can be pivoted at the end opposite its luffing axis via an adjustment cylinder, whereby luffing of the main jib extension can be achieved. The adjustment cylinder is supported on the adapter externally as the fastening frame.

A further adapter for a mobile crane comprising a telescoping jib for luffing a main jib extension is also known from Chinese laid-open document CN 101 898 728 A. The adapter used therein has, instead of the adjustment cylinder, a connecting rod which can varied in length in a stepwise manner by means of bolts.

It is also generally known to bolt a rigid main jib extension directly or via a bending-resistant adapter to a main jib in a fixed angular position between the main jib and main jib extension. In one variant, the main jib extension can also be fastened in other fixed angular positions to the main jib or the adapter. For this purpose, the main jib extension can be pivoted with respect to the main jib or the adapter via two bolt connections. This pivot movement and the subsequent fixing in the other angular position can be affected via hydraulic cylinders or other auxiliary drives connected to plates. In the case of this variant, the load transfer, in particular that of the transverse force, is affected only via the two bolt connections which absorb the forces acting transversely to the system axis. The torsional moments are also distributed only to two bolt connections because the hydraulic cylinders or plates are connected in an articulated manner.

SUMMARY OF THE INVENTION

The invention provides a vehicle crane comprising an adapter between the main jib and main jib extension, of which the load-bearing capacity is improved and the rigging is simplified.

An improvement in the load-bearing capacity as well as a simplification of the rigging of a vehicle crane, in particular a mobile crane or crawler crane, comprising a main jib, a main jib extension and an adapter which is arranged between the main jib and the main jib extension and has a first connection plane and a second connection plane, where the adapter is movable such that the first connection plane can be moved relative to the second connection plane, is achieved by virtue of the fact that the adapter is formed in the manner of a double rocker. This advantageously permits controlled mobility in the region of the adapter. As a result, it is possible to optimize the introduction of force from the main jib extension into the main jib which is associated with an increase in the load-bearing capacity. Moreover, a luffing movement of the main jib extension relative to the main jib can be achieved passively during the course of rigging or actively during operation of the vehicle crane under load. The optimization achieved means that it is possible to avoid use of additional and/or superior material for the adapter in order to passively reduce the deformation of the adapter. Additional and/or superior material or clearly stronger hydraulic cylinders also always disadvantageously signified an increase in costs which is also avoided in this case. Since it is now possible to move the location of the articulation point or the location of the luffing axis for the luffable main jib extension relative to the main jib, on the one hand simplified rigging can be affected with the articulation point in a position "at the front" and after a movement or adjustment of the adapter with the articulation point in a position "in the center" the statics and thus the load-bearing capacity can be improved.

The location of the articulation point "at the front" means that the articulation point or the luffing axis in the second connection plane on the edge of the adapter which faces the ground or is remote from a counterweight of the vehicle crane, i.e. is offset from the center in the direction of the main jib extension. In the position of the adapter with the articulation point "at the front", simple rigging of the main jib extension is made possible. For a better static position, it is also known to have the main jib with an articulation point in the center on the main jib head, i.e. at a spaced interval with respect to the lateral outer edge. The articulation points or the components of the articulation points are subjected to loads of different magnitudes depending upon the setting angle of the additional device. With the new option of adjusting the articulation point, it is possible using the position of the articulation point "in the center" to achieve an optimum introduction of load from the luffable main jib extension into the main jib. As a result, the main jib can be correspondingly more lightweight or achieves greater load capacities. By limiting the axle loads in vehicle cranes to 12 t for operation on roads, in particular in the case of vehicle cranes the weight and thus also the weight of the main jib is an important criterion.

Basically, using the inventive movable adapter it is now possible to luff down a luffable main jib extension via a typical guying arrangement such as the luffing cable and to use the movable adapter instead of the otherwise typical luffing axis.

In one advantageous embodiment, provision is made that the adapter is fastened with its first connection plane indirectly to a main jib head of the main jib and is fastened with its second connection plane indirectly to a foot piece of the main jib extension. In this embodiment, additional intermediate pieces, preferably as lattice mast elements, can thus be provided between the first connection plane and the main jib head and/or the second connection plane and the foot piece of the main jib extension, which can also serve e.g. as an adapter and/or extension. Therefore, an existing adapter in a different construction size can also be used in accordance with the invention between the main jib and main jib extension.

In a preferred embodiment, provision is made that the adapter is fastened with its first connection plane directly to a main jib head of the main jib and/or, preferably and, is fastened with its second connection plane directly to a foot piece of the main jib extension. In an advantageous manner, this optimizes the transmission of force and mobility in the region of the adapter which is arranged in proximity to the main jib head and/or the foot piece.

In one advantageous embodiment of the invention, the adapter is configured as a double rocker. The embodiment as a double rocker permits in particular defined mobility of the adapter and the adapter combines mobility with a high level of static stability.

In an advantageous manner, provision is made that, as seen transversely and laterally with respect to a longitudinal direction of the main jib, the adapter consists of a framework element, a rocker element, a coupling element and a crank element which are connected in a rotary manner via first, second, third and fourth articulation spindles extending in parallel with one another, and arranged between two diagonally opposite articulation spindles is a longitudinally adjustable diagonal element, with which the adapter is fixed.

It is advantageous if the first and fourth articulation spindle lie in the first connection plane and the second and third articulation spindle lie in the second connection plane. The adapter is preferably movable such that the first connection plane is displaced laterally relative to the second connection plane. In particular, the first and second connection planes thus preferably do not move in parallel with one another. On the contrary, provision is advantageously made that the adapter is movable such that the first connection plane is laterally displaced and angled relative to the second connection plane.

The diagonal element can be configured differently. In a particularly preferred manner, the diagonal element is, in particular, a continuously adjustable piston-cylinder unit.

Alternatively, the diagonal element is a sliding plate which can be fixed in different lengths. Therefore, in a preferred manner a 0° position, a 20° position or a 40° position of the main jib extension with respect to the main jib can be set. Depending upon the design, the adapter with the sliding plate as a diagonal can achieve every further pre-set angle between the main jib and main jib extension.

In an alternative embodiment, the diagonal element is a belt which has a pre-selected length and which can be replaced in particular at the time of a position change. In an advantageous manner, the pre-selected length of the belt corresponds to a 0° position, a 20° position or a 40° position of the main jib extension with respect to the main jib.

In a further alternative embodiment, provision is made that the diagonal element can be adjusted, preferably continuously, by means of a toothed rack and gear wheel drive.

In a further preferred embodiment of the invention, the framework element, the rocker element, the coupling element and the crank element are different in length. The same length of the crank element and rocker element is preferred if there is a wish to provide e.g. a pure displacement but not a large rotation of the main jib extension.

Basically, it is also feasible to arrange a plurality of adapters one behind the other, one against the other and/or in a rotated manner in order to increase the mobility per se or to achieve mobility in a plurality of planes.

The rigid design of the movable adapter renders it possible advantageously to configure the adapter to be movable under load. In this case, the positioning of the adjustable diagonal element in the diagonal of the adapter is particularly advantageous because during active movement of the diagonal element under load, the main forces are directed by means of the crank element and the rocker element, and the diagonal element, in particular the piston-cylinder unit, has to transfer only the forces transverse to the system axis.

It is also feasible via a movement of the adapter to actively pretension an outer guying arrangement acting upon the main jib and/or the main jib extension.

The invention will be described in more detail hereinafter with the aid of exemplified embodiments.

DESCRIPTION OF THE PREFERRED EMBODIMENTS

Figure 1:
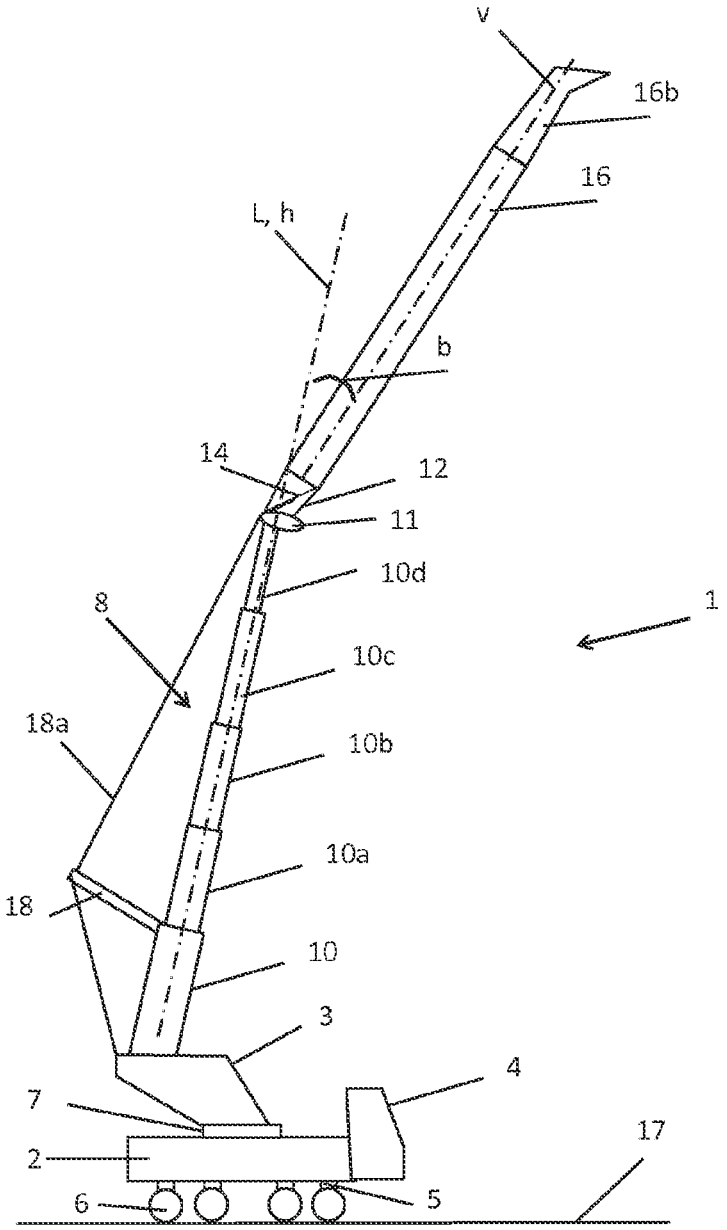
FIG. 1 shows a schematic side view of a vehicle crane comprising a main jib and a rigid main jib extension.

FIG. 1 is a schematic and side view of a vehicle crane 1, in particular a mobile crane, which can travel on public roads and which consists substantially of a lower carriage 2 and a superstructure 3. The lower carriage 2 has a driver's cabin 4 and four vehicle axles 5 each with two rubber-tired wheels 6 suitable for road travel. Of course, the lower carriage 2 can also be equipped with more or fewer than four vehicle axles 5. Furthermore, the lower carriage 2 supports the superstructure 3 which can pivot with respect to the lower carriage 2 about a substantially vertically oriented axis of rotation D by means of a rotary bearing 7. The superstructure 3 and the lower carriage 2 can naturally also be rigidly mounted one on top of the other. A main jib 8 which can be luffed via a luffing cylinder, not illustrated, is mounted on the superstructure 3 and can be completely retracted and placed on the lower carriage 2 for travel on roads. In the illustrated embodiment, the main jib 8 is configured as a telescoping jib. Of course, it is possible for the main jib 8 also to be configured as a lattice mast girder and/or for the vehicle crane 1 to be configured as a crawler crane. The main jib 8 which is configured as a telescoping jib consists of a jib basic box 10 and a plurality of extendible and retractable telescoping sections 10*a* to 10*d* arranged one inside the other. The telescoping section 10*d* which is innermost and thus the smallest in relation to its diameter carries, at is upper or outer end, a main jib head 11. A movable adapter 12 is fastened to the main jib head 11 in a first connection plane I via four bolts or head spindles, not illustrated. The adapter 12 is designed as a cuboidal lattice mast element. A so-called rigid main jib extension 16 is connected to the end of the adapter 12 opposite the main jib head 11 in a second connection plane II via four further bolts, not illustrated, said main jib extension being oriented typically only in one orientation with respect to the main jib 8 via the adapter 12.

The adapter 12 in accordance with the invention is movable and lockable to a limited extent such that the main jib extension 16, with its longitudinal direction v in a pre-selected orientation with respect to the longitudinal direction h of the main jib 8, can be connected to the adapter 12, or the adapter 12 with the connected main jib extension 16 can be oriented accordingly. In FIG. 1, the main jib extension 16 is inclined by an angle b of about 20° with respect to the main jib 8.

In a preferred embodiment, the main jib 8 also comprises a first guying support 18 which is arranged on the head of jib basic box 10, points rearwards at a right angle and via which a first guying cable 18*a* extends from the base of the basic box 10 via the guying support 18 to the main jib head 11.

Typically, the main jib extension 16 is divided into a basic jib designed as a lattice mast and conventionally being of latticework tubular construction, and a tip 16*b* adjoining same and designed as a box jib or latticework tubular construction. Such main jib extensions 16 are fundamentally constructed as modular design systems from individual main elements and can be fitted together depending on the required length or load capacity thereof. The individual main elements have dimensions suitable for transportation and in most cases are not carried along with the vehicle crane 1 but are transported separately. When the spindle loads of the vehicle crane 1 and the construction size of the main jib extension 16 allow, the main jib extension 16 can be carried along if required.

Figure 2C:
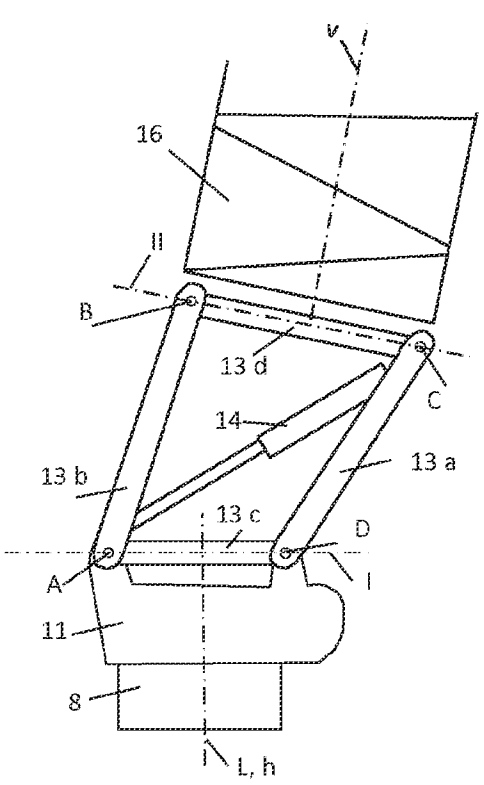
FIGS. 2*a* to 2*c* show a detailed view of the vehicle crane shown in FIG. 1 from the region of an adapter between the main jib and the main jib extension in various positions.
Figure 2B:
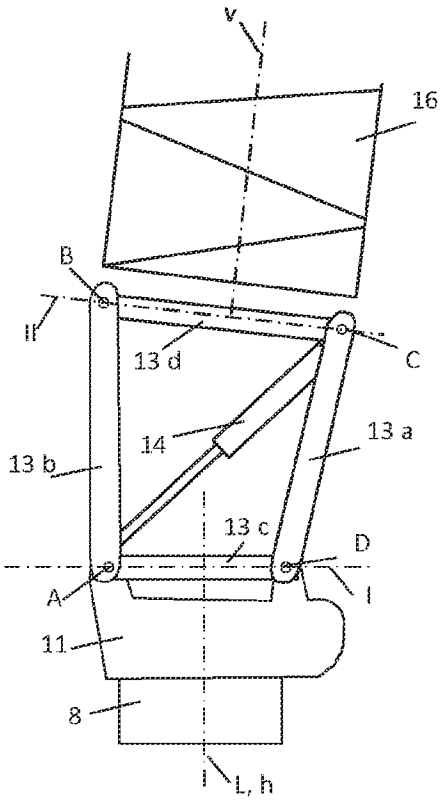
Figure 2A:
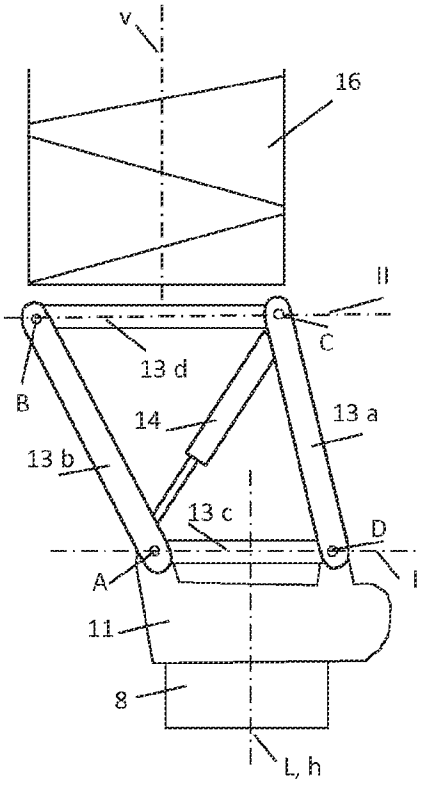

FIGS. 2*a*, 2*b* and 2*c* show a detailed view of the adapter 12 of the vehicle crane 1 of FIG. 1 in three different positions. The adapter 12 which is designed in the form of a truncated pyramid or trapezoidal prism and preferably as a lattice mast element consists, as seen from the side, on each side in accordance with the designations typically used for an articulated quadrilateral, of a crank element 13*a* arranged on the right, a rocker element 13*b* arranged on the left, a framework element 13*c* arranged at the bottom and a coupling element 13*d* arranged at the top, which in the form of an articulated quadrilateral are connected to one another in the manner of a double rocker via rotatable articulation means A, B, C and D. As seen spatially, the two opposite crank elements 13*a*, of which FIGS. 2*a* to 2*c* show only the front one, are connected via upper and lower transverse beams, not illustrated, to form a rear frame. The same applies to the two rocker elements 13*b* which are connected via transverse beams, also not illustrated, to form a front frame. The front frame and the rear frame are then connected via the two framework elements 13*c* and the two coupling elements 13*d* to form the adapter 12.

The geometric ratios, in particular the lengths of the crank element 13*a*, the rocker element 13*b*, the framework element 13*c* and the coupling element 13*d* with respect to one another are selected such that in a 0° position or basic position of the main jib extension 16 with respect to the main jib 8, a first connection plane I extends in parallel with a second connection plane II. The two first articulation spindles A, the two fourth articulation spindles D and also the two framework elements 13*c* lie with their longitudinal extension in the first connection plane I. The two second articulation spindles B, the two third articulation spindles C and also the two coupling elements 13*d* lie with their longitudinal extension in the second connection plane II. It is evident in associated FIG. 2*a* that by reason of the mutually parallel connection planes I and II and the mutually different lengths of the crank element 13*a* and the rocker element 13*b*, the longitudinal extension v of the main jib extension 16 extends in parallel with the longitudinal extension h of the main jib 8 and in this case said extensions are not aligned with one another but instead are laterally offset with respect to one another—as seen in a side view of the main jib 8. In particular, in this case the rocker element 13*a* and the coupling element 13*d* are not equal in length and are arranged at an acute angle with respect to one another. In contrast to a conventional articulated quadrilateral, the crank element 13*a* and also the rocker element 13*b* are not arranged in a rotary manner but instead pivot only about the associated articulation spindles A and D in order to affect the desired displacement of the connection plane II with respect to the connection plane I.

In order to limit the mobility of the adapter 12 or to establish the orientation of the connection plane II with respect to the connection plane I, at least one diagonal element or component 14 is provided which is arranged in a diagonal of the articulated quadrilateral formed by the elements 13*a* to 13*d*. For this purpose, the diagonal element 14 acts, on the one hand, in an articulated manner in the region of the articulation spindle A on a plate of the rocker element 13*b* and acts, on the other hand, in an articulated manner in the region of the articulation spindle C on a plate of the crank element 13*a*. In the present exemplified embodiment, a front and a rear diagonal element 14 are provided in each case in the front and the rear articulated quadrilateral of the adapter 12. Basically, it is also possible to use only one diagonal element 14 which is then arranged preferably centrally in the adapter 12. It is also possible to rotate the diagonal element 14 about ca. 90 degrees and thus connect it, on the one hand, in an articulated manner in the region of the articulation spindle D to a plate of the crank element 13*a* and connect it, on the other hand, in an articulated manner in the region of the articulation spindle D to a plate of the rocker element 13*b*.

Figure 5C:
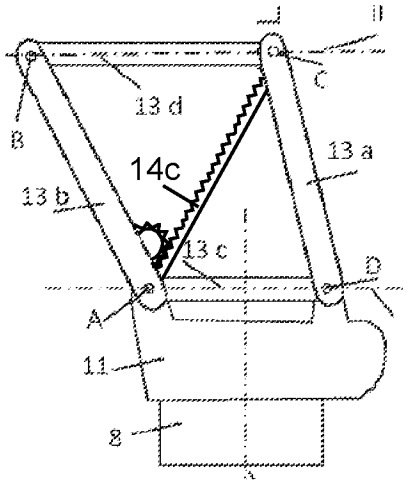
FIG. 5*c* shows a detailed view of the vehicle crane of FIG. 1 from the region of an adapter in which a diagonal element is in the form of a toothed rack and gear wheel drive.
Figure 5B:
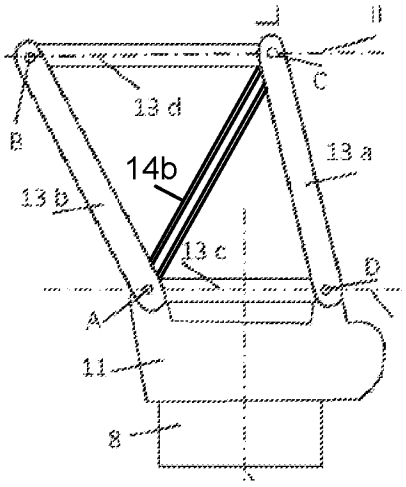
FIG. 5*b* shows a detailed view of the vehicle crane of FIG. 1 from the region of an adapter in which a diagonal element is in the form of a replaceable belt.
Figure 5A:
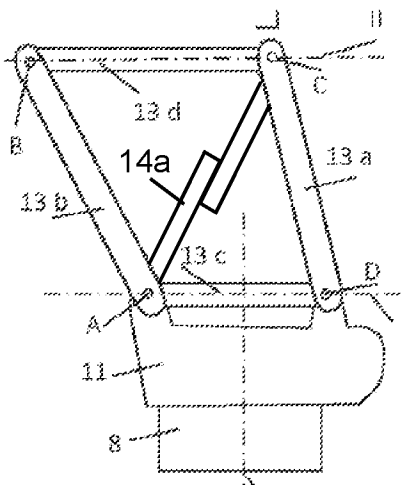
FIG. 5*a* shows a detailed view of the vehicle crane of FIG. 1 from the region of an adapter in which a diagonal element is in the form of a sliding plate.

The diagonal element 14 is designed preferably as a sliding plate 14*a* (FIG. 5*a*) which can be fixed in different lengths via bolts. A design as a set of bars each having a fixed length is also feasible. It is likewise advantageously possible to design the diagonal element 14 as a hydraulically driven piston-cylinder unit which is then locked in the desired lengths in a hydraulic manner via corresponding valves. The diagonal element 14 can also be adjustable and fixable in terms of its length by means of a toothed rack and a gear wheel drive 14*c* (FIG. 5*c*) which meshes therewith. With reference to FIG. 5*b*, the diagonal element 14 may also take the form of a replaceable belt 14*b* having a pre-selected length. In addition, the diagonal element 14 also affects stiffening of the adapter 12.

FIGS. 2*a* to 2*c* schematically illustrate a lattice piece from the base region of the main jib extension 16 which is connected to the adapter 12, in particular to the coupling element 13*d*, via plates, not illustrated, and corresponding bolts. As a result, the longitudinal direction v of the main jib extension 16 is then oriented at a right angle to the coupling element 13*d*. The lattice piece—illustrated schematically as a rectangle—of the main jib extension 16 is typically part of the lattice mast-like formation of the main jib extension 16.

FIG. 2*a* shows the adapter 12 in a basic position which corresponds to a 0° position of the main jib extension 16 in relation to the parallel orientation of the longitudinal direction h of the main jib 8 with respect to the longitudinal direction v of the main jib extension 16. In this case, the length of the diagonal element 14 is at its shortest. FIG. 2*a* also shows that the central longitudinal direction v of the main jib extension 16 is arranged in a manner offset laterally to the left with respect to the central longitudinal direction h of the main jib 8 and in this case a central longitudinal direction v of the main jib extension 16 lies approximately as an extension of a top side of the main jib 8. In this case, the adapter 12 per se is inclined to the left in particular in relation to its crank element 13*a* and its rocker element 13*b*. In order to be able to fasten the main jib extension 16 to the main jib 6 not only in the 0° position but also in other orientations, the adapter 12 can be pivoted laterally, as previously described. As a result, the second connection plane II is displaced laterally with respect to the first connection plane I and in this case tilts starting from the parallel basic position to any angles, preferably to the typical 20° position or 40° position. In this case, the same then applies for the orientation of the longitudinal direction v of the main jib extension 16 with respect to the longitudinal direction h of the main jib 8. The articulation points B and C and the crank element 13*a*, the rocker element 13*b* and the coupling element 13*d* are displaced in the manner of the double rocker. The articulation points A and D and the framework element 13*c* do not change position on the main jib 6 or the main jib head 11.

FIG. 2*b* shows the adapter 12 in a 20° position of the main jib extension 16. In this case, the diagonal element 14 has a longer length than in the 0° position. FIG. 2*b* also shows that the central longitudinal direction v of the main jib extension 16 in the foot piece 16*a* is approximately an extension of the central longitudinal direction h of the main jib 8. In this case, the adapter 12 per se is arranged almost upright in particular in relation to its crank element 13*a* and its rocker element 13*b*, albeit inclined in each case to the left or right.

FIG. 2*c* shows the adapter 12 in a 40° position of the main jib extension 16. In this case, the length of the diagonal element 14 is at its longest. FIG. 2*c* also shows that the central longitudinal direction v of the main jib extension 16 is arranged in a manner offset laterally to the right with respect to the central longitudinal direction h of the main jib 8 and in this case a central longitudinal direction v of the main jib extension 16 lies against the foot piece 16*a* approximately as an extension of a bottom side of the main jib 8. In this case, the adapter 12 per se is inclined to the right in particular in relation to its crank element 13*a* and its rocker element 13*b*.

By placing the adapter 12 between the main jib 8 and main jib extension 16, it is possible to angle the main jib extension 16 relative to the main jib 8 through the use of diagonal elements 14 of different length.

Figure 3:
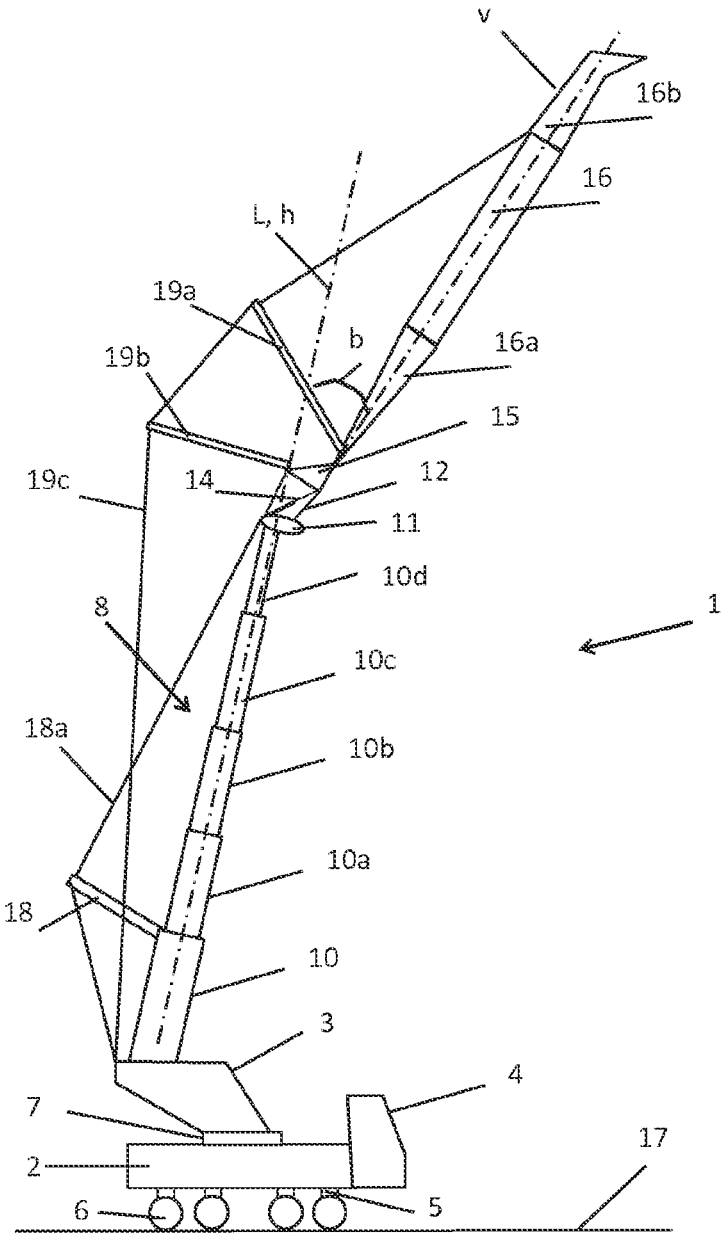
FIG. 3 shows a schematic side view of a vehicle crane comprising a main jib and a luffable main jib extension.

FIG. 3 shows a schematic side view of the vehicle crane 1 comprising a main jib 8 shown in FIG. 1, on which a luffable main jib extension 16, instead of a rigid main jib extension 16, is arranged. Therefore, with respect to the corresponding parts of the vehicle crane 1 reference is made to the above description relating to FIG. 1. Only the differences will be discussed hereinafter.

In order to achieve the luffability of the main jib extension 16, the lattice mast-like foot piece 16 is typically wedge-shaped in the form of a flat tip having a tip directed in the direction of the main jib 8. In the region of the tip, the luffing axis w extends over the entire width of the foot piece 16*a* which is formed from one or a plurality of bolt connections. In this case, the luffing axis w is oriented transversely with respect to the longitudinal direction h of the main jib extension 16 and to the greatest possible extent horizontally. It is also evident that the luffing axis w is approximately in the center in relation to the front side and rear side of the adapter 12.

In addition to the guying of the main jib 8 to the first guying support 18 already described in FIG. 1, the embodiment shown in FIG. 3 comprises a second guying of the main jib extension 16. For this purpose, a second guying support 19*a* and a third guying support 19*b* are connected in the region of the luffing axis w. A guying cable 19*c* is guided starting from the superstructure 3 to the guying support 19*b* and guying rods to a point approximately in the center on the main jib extension 16. By means of this guying cable 19*c*, the main jib extension 16 is actively luffed even under load.

Figure 4A:
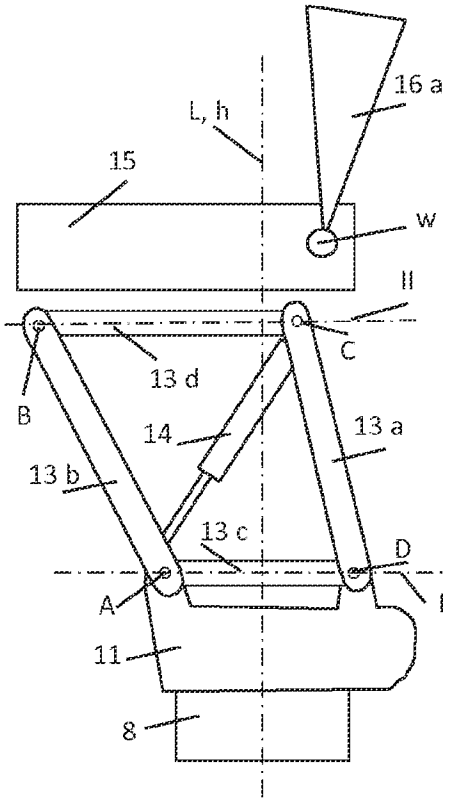
FIGS. 4*a* to 4*c* show a detailed view of the vehicle crane shown in FIG. 3 from the region of an adapter between the main jib and the main jib extension in various positions.
Figure 4B:
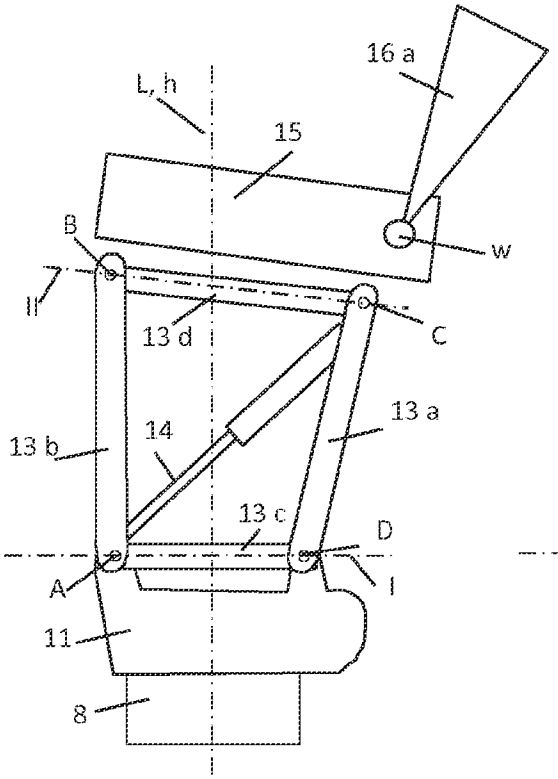
Figure 4C:
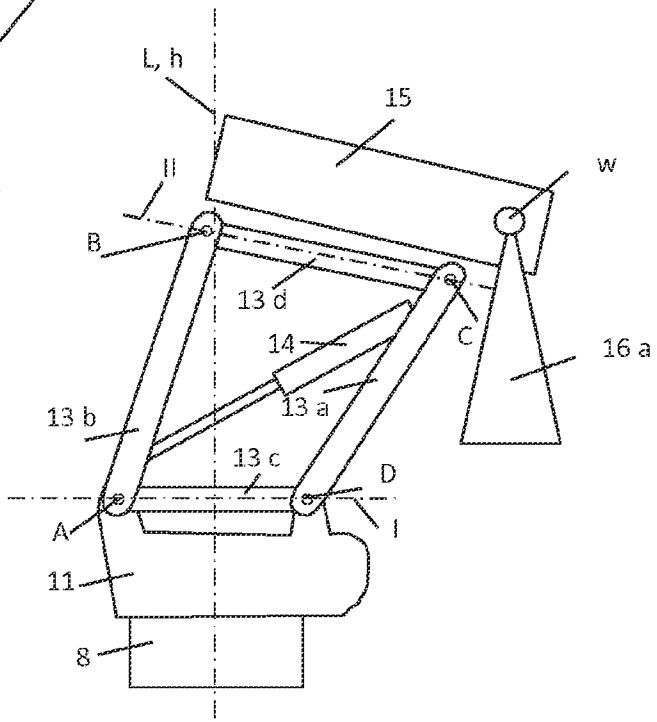

FIGS. 4*a*, 4*b* and 4*c* show a detailed view of the adapter 12 of the vehicle crane 1 shown in FIG. 3 in three different positions, wherein the adapter 12 as a diagonal element 14 has a hydraulic piston-cylinder unit instead of the diagonal element 14 having a fixed or set length. Therefore, with respect to the corresponding parts of the adapter 12 reference is made to the above description relating to FIGS. 2*a*, 2*b* and 2*c*. Only the differences will be discussed hereinafter. Moreover, for reasons of clarity the second and third guying supports 19*a*, 19*b* are not illustrated in FIGS. 4*a* to 4*c*.

Furthermore, it is evident in FIGS. 4*a*, 4*b* and 4*c* that, contrary to the embodiment shown in FIG. 3, the luffing axis w is not in the center between the second articulation spindles B and third articulation spindles C but instead in the region of the front third articulation spindle C preferably even protruding slightly to the front beyond the third articulation spindle C and thus the edge of the adapter 12 and the main jib head 11 adjoining thereunder. For this purpose, a foot link adapter 15 is arranged between the adapter 12 and the main jib extension 16. The arrangement of the luffing axis w allows a rigging procedure for the main jib extension 16, in which the main jib extension 16 is suspended perpendicularly downwards from the raised main jib 8. This position of the main jib extension 16 is indicated in FIG. 4*c*.

As stated previously, the adapter 12 shown in FIGS. 4*a* to 4*c* has a diagonal element 14 which is designed as a piston-cylinder unit in order to permit continuous luffing of the main jib extension 16 about the luffing axis w during active operation. As in FIGS. 2*a* to 2*c*, the adapter 12 in FIGS. 4*a* to 4*c* is illustrated in a 0° position, a 20° position and a 40° position. Accordingly, the diagonal element 14 has been extended to different extents. In FIG. 4*b*, the diagonal element 14 has been extended slightly and is no longer in the almost completely extended position, as illustrated in FIG. 4*c*.

The view shown in FIG. 4*c* corresponds to the 40° position of the main jib 8, adapter 12 and main jib extension 16. For this purpose, the diagonal element 14 has been retracted a further distance.

The present invention has been described above in connection with a mobile crane comprising a telescopic main jib 8 and a lattice mast-like main jib extension 16. Since the core of the invention relates to the pivotable configuration of the adapter 12, the concept can also be transferred to other configurations and combinations of the main jib 8 and main jib extension 16 and these can be transferred to other vehicle cranes 1 such as e.g. a crawler crane.

In the exemplified embodiments above, the framework element 13*c*, the rocker element 13*b*, the coupling element 13*d* and the crank element 13*a* are each described as being different in length. As seen in the side view, it is also feasible to have a parallelogram-like formation of the adapter 12, in which at least the crank element 13*a* and the rocker element 13*b* are the same length. The main jib extension 16 can then be displaced laterally and without luffing with respect to the main jib 8 via this adapter 12. This embodiment could be practical in connection with a luffable main jib extension 16.

In relation to the adapter 12, it should be noted that its function is also retained if the framework element 13*c* arranged at the bottom is replaced by the main jib head 11. Furthermore, its function is retained if the coupling element 13*d* is replaced by other components, such as e.g. a further adapter piece or the foot piece 16*a*.

The invention claimed is:

1. A vehicle crane, the vehicle crane comprising:

a main jib;

a main jib extension; and an adapter;

wherein the adapter is formed as a double rocker and is arranged between the main jib and the main jib extension and has a first connection plane and a second connection plane, and wherein the adapter is movable such that the first connection plane can be laterally and angularly moved relative to the second connection plane, wherein, as seen transversely and laterally with respect to a longitudinal direction of the main jib, the adapter consists of a framework element, a rocker element, a coupling element and a crank element that are connected in a rotary manner via a first articulation spindle, a second articulation spindle, a third articulation spindle and a fourth articulation spindle that extend in parallel with one another, and wherein a diagonal component with which the adapter is fixed is arranged between two diagonally opposite articulation spindles of the first, second, third and fourth articulation spindles.

2. The vehicle crane as claimed in claim 1, wherein the adapter is fastened with its first connection plane indirectly to a main jib head of the main jib and is fastened with its second connection plane indirectly to a foot piece of the main jib extension.

3. The vehicle crane as claimed in claim 1, wherein the adapter is fastened with its first connection plane directly to a main jib head of the main jib and/or is fastened with its second connection plane directly to a foot piece of the main jib extension.

4. The vehicle crane as claimed in claim 1, wherein the first and fourth articulation spindles lie in the first connection plane and the second and third articulation spindles lie in the second connection plane.

5. The vehicle crane as claimed in claim 1, wherein the diagonal component is an adjustable piston-cylinder unit.

6. The vehicle crane as claimed in claim 1, wherein the diagonal component is a sliding plate that is fixable in different lengths.

7. The vehicle crane as claimed in claim 1, wherein the diagonal component is a replaceable belt having a preselected length.

8. The vehicle crane as claimed in claim 1, wherein the diagonal component is adjustable via a toothed rack and gear wheel drive.

9. The vehicle crane as claimed in claim 1, wherein the framework element, the rocker element, the coupling element and the crank element are different in length.

10. The vehicle crane as claimed in claim 1, wherein a plurality of adapters are arranged one behind the other, one against the other and/or in a rotated manner.

11. The vehicle crane as claimed in claim 1, wherein the adapter is moveable under load.

12. The vehicle crane as claimed in claim 1, wherein an outer guying arrangement acting upon the main jib and/or the main jib extension is configured to be actively pretensioned via a movement of the adapter.

13. A vehicle crane, the vehicle crane comprising:

a main jib;

a main jib extension; and an adapter;

wherein the adapter is formed as a double rocker and is arranged between the main jib and the main jib extension and has a first connection plane and a second connection plane, and wherein the adapter is movable such that the first connection plane can be laterally and angularly moved relative to the second connection plane, and wherein the adapter is fastened (i) with its first connection plane indirectly to a main jib head of the main jib and is fastened with its second connection plane indirectly to a foot piece of the main jib extension, or (ii) with its first connection plane directly to a main jib head of the main jib and/or is fastened with its second connection plane directly to a foot piece of the main jib extension.

14. The vehicle crane as claimed in claim 13, wherein, as seen transversely and laterally with respect to a longitudinal direction of the main jib, the adapter consists of a framework element, a rocker element, a coupling element and a crank element that are connected in a rotary manner via a first articulation spindle, a second articulation spindle, a third articulation spindle and a fourth articulation spindle that extend in parallel with one another, and wherein a diagonal component with which the adapter is fixed is arranged between two diagonally opposite articulation spindles of the first, second, third and fourth articulation spindles.

15. The vehicle crane as claimed in claim 14, wherein the first and fourth articulation spindles lie in the first connection plane and the second and third articulation spindles lie in the second connection plane.

16. The vehicle crane as claimed in claim 14, wherein the diagonal component is an adjustable piston-cylinder unit.

17. The vehicle crane as claimed in claim 14, wherein the diagonal component is a sliding plate that is fixable in different lengths.

18. The vehicle crane as claimed in claim 14, wherein the diagonal component is a replaceable belt having a preselected length.

19. The vehicle crane as claimed in claim 14, wherein the diagonal component is adjustable via a toothed rack and gear wheel drive.

* * * * *